US005368230A

United States Patent [19]

Oppenberg

[11] Patent Number: 5,368,230

[45] Date of Patent: Nov. 29, 1994

[54] ATOMIZER FOR AN OIL BURNER

[75] Inventor: Rolf Oppenberg, Wesel, Germany

[73] Assignee: Babcock Feuerungssysteme GmbH, Oberhausen, Germany

[21] Appl. No.: 132,641

[22] Filed: Oct. 6, 1993

[30] Foreign Application Priority Data

Nov. 17, 1992 [DE] Germany ..... 4238736

[51] Int. Cl.[5] ..... F23D 11/12; F23D 11/10; F23D 11/18

[52] U.S. Cl. ..... 239/132.5; 239/427.3; 239/433

[58] Field of Search ..... 239/427, 427.3, 429, 239/433, 132.5

[56] References Cited

U.S. PATENT DOCUMENTS 4,002,297 1/1977 Pillard ..... 239/433
4,356,970 11/1982 Vosper et al. ..... 239/427.3
4,890,793 1/1990 Füglistaller et al. ..... 239/427
5,170,942 12/1992 Spink et al. ..... 239/427.3
5,176,324 1/1993 Furuse et al. ..... 239/433

FOREIGN PATENT DOCUMENTS 55-65814 5/1980 Japan ..... 239/427
58-86316 5/1983 Japan ..... 239/433
62-112905 5/1987 Japan ..... 239/433
62-155426 7/1987 Japan ..... 239/433
985576 12/1982 U.S.S.R. ..... 239/427

*Primary Examiner*—Karen B. Merritt
*Attorney, Agent, or Firm*—Max Fogiel

[57] ABSTRACT

An atomizer for an oil burner. One line supplies liquid fuel and another line supplies atomization fluid to a mixing chamber. The mixing chamber is accommodated in a nozzle and provided with outlet bores. A bore that communicates with the atomization-fluid supply line slopes through the nozzle and into each outlet bore.

5 Claims, 2 Drawing Sheets

ATOMIZER FOR AN OIL BURNER

BACKGROUND OF THE INVENTION

Devices called Y nozzles are employed to atomize heating oil (U.S. Pat. No. 2,480,459). Slightly superheated atomization fluid is forced at a constant pressure of 10 to 11 bars out of the nozzle and into the combustion chamber through several bores oriented at a specific angle. Before exiting, the fluid is contacted with the oil in the slightly wider stem of the Y. The expanding fluid bombards the oil into tiny droplets.

Special devices called premix nozzles for atomizing heavy heating oil are also known. The oil enters a liquid-fuel and atomization-fluid mixing chamber through a central pipe. Separate bores that convey atomization fluid also enter the fuel-and-fluid mixing chamber more or less at tangents. The fluid phases are similar to those that occur in a Y nozzle. The oil and atomization fluid are turbulently blended in the mixing chamber and open into the combustion chamber at a specific angle.

The bores that open into the liquid-fuel and atomization-fluid mixing chamber in a known premix nozzle (VGB Kraftwerkstechnik 56 [1956], 622–29) are Y nozzles. The bores that open out of the fuel-and-fluid mixing chamber are distributed along two arcs of a circle. The axes of the bores along each arc are at the same angle to the longitudinal axis of the atomizer. Another known premix nozzle (German Patent 3 442 148) employs a series of two mixing chambers. The bores that open out of the downstream chamber have graduated diameters and are asymmetrical to the longitudinal midplane. These features allow discontinuous supply of oil to the combustion chamber. Due to increasing demands for decreased emission of pollutants and to the decreasing quality of heating oil, known premix nozzles do not atomize the fuel adequately.

SUMMARY OF THE INVENTION

The object of-the present invention is accordingly an improvement in the generic atomizer that will allow it to atomize even heavy heating and special-purpose oils sufficiently to facilitate their combustion.

Since the atomization fluid is injected at overlapping intervals in the atomizer in accordance with the invention, atomization occurs twice, once in the liquid-fuel and atomization-fluid mixing chamber and once before leaving through the Y-shaped bores that open out of that chamber. This double atomization, which occurs entirely inside the nozzle, represents a substantial improvement in the processing of even difficult oils, ensuring total combustion and less pollution.

The overlapping injection will as recited in claim 4 herein allow some of the atomization fluid to be exploited as a coolant and sealant for the loosely attached components of the nozzle, which are exposed to the very hot atmosphere of the combustion chamber. The cooling will loosen the forcedtogether components and prevent the oil from leaking. The grouping of separate Y-shaped and variously sloping outlet bores allows discontinuous supply of fuel to the combustion chamber, which helps reduce the formation of nitrogen oxide during combustion.

BRIEF DESCRIPTION OF THE DRAWINGS

Various embodiments of the invention will now be specified with reference to the drawing, wherein.

DESCRIPTION OF THE PREFERRED EMBODIMENTS

Figure 1:
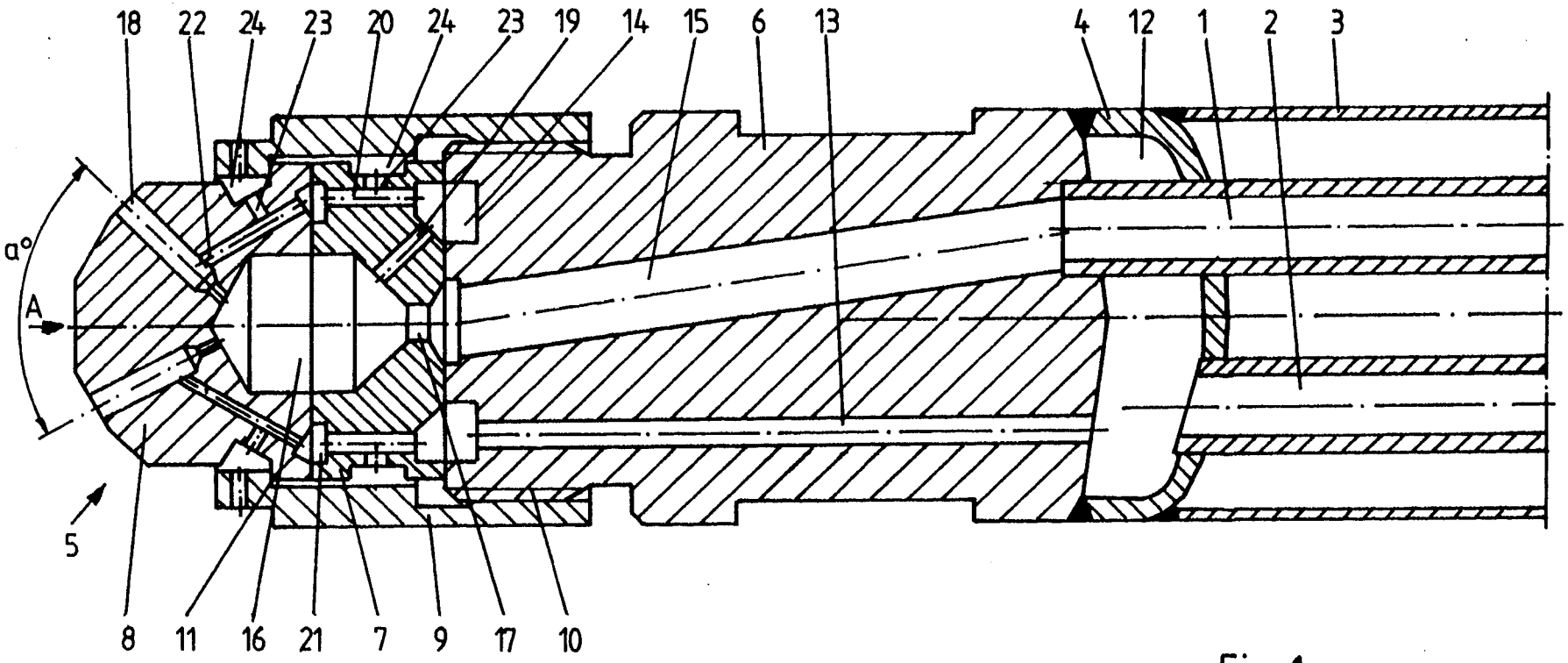
FIG. 1 is a longitudinal section through the front of an atomizer.
Figure 2:
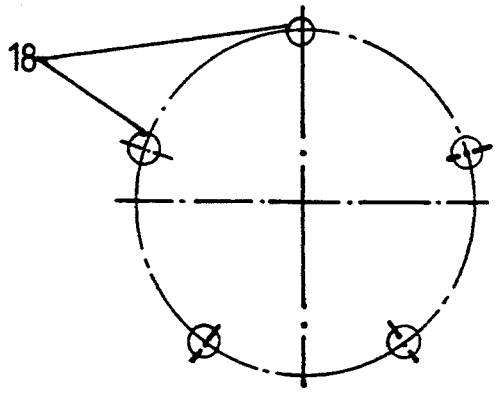
FIG. 2 is a view from direction A of the atomizer illustrated in FIG. 1.

The illustrated atomizer is part of a burner that burns liquid fuel, especially heavy heating or special-purpose oil while emitting low levels of pollution. The atomizer includes two supply lines 1 and 2. Line 1 supplies the oil and line 2 an atomization fluid in the form of vapor or gas. The vapor can be steam and the gas air for instance. Supply lines 1 and 2 are accommodated in a protective outer pipe 3. Outer pipe 3 communicates by way of a base 4 with a nozzle 5. Nozzle 5 comprises a head 6, an intermediate 7, and a cap 8. Head 6, intermediate 7, and cap 8 are forced tight together by a collar 9 with an internal thread 10 that screws onto an external thread on the head. Tightening collar 9 has a shoulder 11 inside it that rests against another shoulder on cap 8 when collar 9 is tight.

Atomization-fluid supply line 2 opens into a collecting chamber 12 between base 4 and nozzle head 6. One or more bores 13 extend through nozzle head 6. Bores 13 provide communication between chamber 12 and an annular atomization-fluid distributor 14 where nozzle head 6 rests against intermediate 7. Fuel-supply line 1 extends tightly through atomization-fluid collecting chamber 12 and opens into a fuel-injection channel 15 that extends through nozzle head 6.

Intermediate 7 demarcates in conjunction with cap 8 a mixing chamber 16. Mixing chamber 16 communicates with fuel-injection channel 15 through a fuel-admission aperture 17 at the center of intermediate 7. The downstream wall of mixing chamber 16 is provided with several outlet bores 18. Each outlet bore 18 extends through cap 8 at an angle to its longitudinal axis. Each outlet bore 18 comprises two sections that differ in diameter. The wider section is toward the outside.

Several mixing-chamber intake bores 19 slope out of atomization-fluid distributor 14 and approximately tangentially into mixing chamber 16. Additional bores 20 extend axially out of fluid distributor 14, through intermediate 7, and into another annular atomization-fluid distributor 21 where cap 8 rests against intermediate 7. Additional bores 22 extend out of second fluid distributor 21, through cap 8, and into the wider section of outlet bores 18, creating reversed-Y channels.

The liquid heating oil entering mixing chamber 16 from fuel-injection channel 15 is agitated by the atomization fluid entering through intake bores 19 and leaves turbulent through outlet bores 18. Before emerging from the outlet bores, however, the fuel is subjected to additional agitation by fluid entering the bores through sloping bores 22.

There is a groove 24 around 7. Axial bores 20 communicate with groove 24 through radial bores 23. There is another groove 24 around cap 8. Bores 22 communicate with second groove 24 through additional radial bores 23. Some of the atomization fluid is diverted through radial bores 23 and functions as a coolant and seal in the gap between intermediate 7 and cap 8 and collar 9 and between cap 8 and collar 9.

Figure 3:
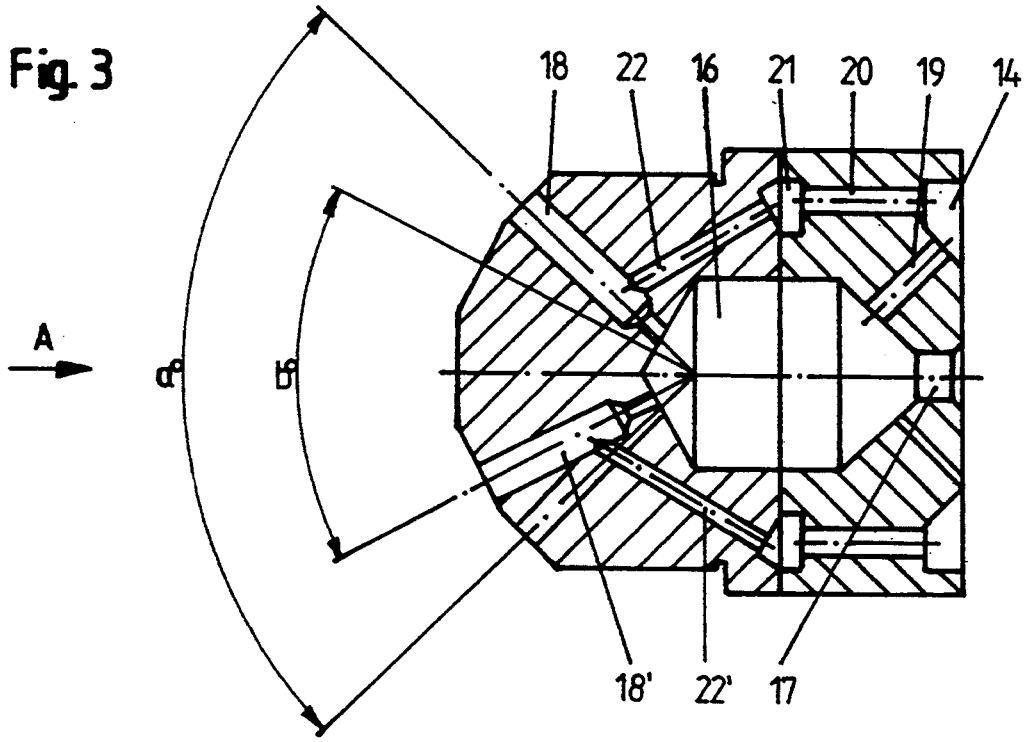
FIG. 3 is a longitudinal section through the nozzle in another embodiment of an atomizer.
Figure 4:
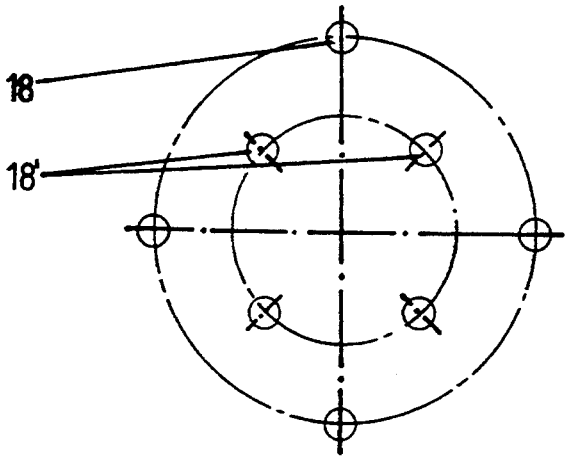
FIG. 4 is a view from direction A of the atomizer illustrated in FIG. 3.

The axes of the outlet bores 18 in the embodiment illustrated in FIG. 1 are at an angle a ° to one another. It is also possible as illustrated in FIGS. 3 and 4 for outlet bores 18 to be distributed along one or more arcs of circles. In this event the axes of the outlet bores 18' along the arc of the smaller circle will be separated by an angle b ° that is more acute than the angle a ° between the axes of the outlet bores 18 along the arc of the larger circle.

More fuel can be ejected through the outlet bores along one arc than through the other bores, More fuel will in this event be ejected through the bores 18' along the arc of the inner circle and at the more acute angle to one another.

This fuel will penetrate farther into the combustion chamber, decreasing the amount of nitrogen oxides that occur during combustion. When the device is stoked from the front, the differential fuel supply can be ensured by making the upward-sloping outlet bores 18 in the horizontal atomizer wider than the downward sloping outlet bores 18, so that more fuel will be ejected through the former.

I claim:

1. An atomizer for an oil burner, comprising: a first supply line for supplying oil; a second supply line for supplying an atomizing medium; a nozzle head; a mixing chamber communicating with said first supply line and said second supply line and formed in said nozzle head; said mixing chamber having exit bores; said nozzle head having bores connected with said second supply line, each of said bores of said nozzle head terminating at an angle with one of said exit bores of said mixing chamber; said mixing chamber being connected to said second supply line through entrance bores inclined to said mixing chamber, said oil being atomized in said exit bores, said oil being pre-atomized by said atomizing medium and mixed with said atonizing medium in said mixing chamber.

2. An atomizer as defined in claim 1, wherein said exit bores are distributed into groups, exit bores in one group forming a first angle with respect to one another, exit bores in another group forming a second angle with respect to one another, said second angle differing from said first angle.

3. An atomizer as defined in claim 1 wherein said exit bores are comprised of two sections, one section differing in diameter from the other section.

4. An atomizer for an oil burner, comprising: a first supply line for supplying oil; a second supply line for supplying an atomizing medium; a nozzle head; a mixing chamber communicating with said first supply line and said second supply line and formed in said nozzle head; said mixing chamber having exit bores; said nozzle head having bores connected with said second supply line, each of said bores of said nozzle head terminating at an angle with one of said exit bores of said mixing chamber; said nozzle head comprising a plurality of components; a collar for holding together said plurality of components and spaced by a gap from said nozzle head, atomizing medium being injected through said bores of said nozzle head and into said gap between said nozzle head and said collar, and radial bores branching out of said bores of said nozzle head.

5. An atomizer for an oil burner, comprising: a first supply line for supplying oil; a second supply line for supplying an atomizing medium; a nozzle head; a mixing chamber communicating with said first supply line and said second supply line and formed in said nozzle head; said mixing chamber having exit boxes; said nozzle head having bores connected with said second supply line, each of said bore of said nozzle head terminating at an angle with one of said exit bores of said mixing chamber; said mixing chamber being connected to said second supply line through entrance bores inclined to said mixing chamber, said oil being atomized in said exit bores, said oil being pre-atomized by said atomizing medium and mixed with said atomizing medium in said mixing chamber; said exit bores being distributed into groups, exit bores in one group forming a first angle with respect to one another, exit bores in another group forming a second angle with respect to one another, said second angle differing from said first angle; said exit bores are comprised of two sections, one section differing in diameter from the other section; said nozzle head comprising a plurality of components; a collar for holding together said plurality of components and spaced by a gap from said nozzle head, atomizing medium being injected through said bores of said nozzle head and into said gap between said nozzle head and said collar, and radial bores branching out of said bores of said nozzle head.

* * * * *